US005501198A

United States Patent [19]

Koyama

[11] Patent Number: 5,501,198

[45] Date of Patent: Mar. 26, 1996

[54] FUEL VAPOR CONTROL APPARATUS FOR AN INTERNAL COMBUSTION ENGINE

[75] Inventor: Nobuhiko Koyama, Nagoya, Japan

[73] Assignee: Nippondenso Co., Ltd., Kariya, Japan

[21] Appl. No.: 384,487

[22] Filed: Feb. 1, 1995

[30] Foreign Application Priority Data

Feb. 2, 1994 [JP] Japan ..... 6-031857

[51] Int. Cl.[6] ..... F02M 37/04

[52] U.S. Cl. ..... 123/520; 123/198 D

[58] Field of Search ..... 123/520, 518, 123/519, 521, 516, 198 D

[56] References Cited

U.S. PATENT DOCUMENTS

| | | | |
|---|---|---|---|
| 4,175,526 | 11/1974 | Phelan | 123/520 |
| 4,598,686 | 7/1986 | Lupoli | 123/519 |
| 4,658,796 | 4/1987 | Yoshida | 123/516 |
| 5,327,873 | 7/1994 | Ohuchi | 123/198 D |
| 5,363,828 | 11/1994 | Yamashita | 123/198 D |

FOREIGN PATENT DOCUMENTS

| | | | |
|---|---|---|---|
| 1125553 | 5/1989 | Japan . | |
| 4153556 | 5/1992 | Japan . | |
| 4203258 | 7/1992 | Japan | 123/519 |
| 4505491 | 9/1992 | Japan . | |
| 5202812 | 8/1993 | Japan | 123/519 |
| 6-25654 | 7/1994 | Japan . | |

*Primary Examiner*—Carl S. Miller
*Attorney, Agent, or Firm*—Cushman, Darby & Cushman

[57] ABSTRACT

Operation of a fuel vapor control apparatus having a canister and a fuel vapor purging passage is detected occasionally by a pressure sensor which is disposed in a fuel tank of an engine. The sensor detects pressure changes in the purging passage caused by closing or opening the passage between the canister and a suction pipe of the engine, and by introducing or by interrupting the air flowing into the canister. A computer calculates signals generated by the sensor and decides whether or not any failure has occurred in the fuel vapor control apparatus. An air intake unit which has an air filter and an air switching valve is detachably installed close to the canister. When the air switching valve is controlled to introduce the air into the canister, the air passes the filter before the switching valve so that the valve may not be subject to dust or foreign particles contained in the air and good sealing of the valve is ensured for long time. As a result, highly reliable failure detection is attained, and the apparatus is easy to be installed in a vehicle.

10 Claims, 2 Drawing Sheets

FUEL VAPOR CONTROL APPARATUS FOR AN INTERNAL COMBUSTION ENGINE

CROSS REFERENCE TO RELATED APPLICATION

The present application is based on and claims priority from Japanese Patent Application No. Hei 6-31857 filed on Feb. 2, 1994, the content of which is incorporated herein by reference.

BACKGROUND OF THE INVENTION

1. Field of the Invention

This invention relates to a fuel vapor control apparatus to prevent diffusion of the fuel vapor generated in the fuel tank.

2. Related Art

Conventionally, vehicles and the like have been using a fuel vapor control apparatus to prevent the fuel vapor in the fuel tank from diffusing to the atmosphere. The fuel vapor control apparatus has a canister disposed in a passage connecting the fuel tank and the suction pipe of an engine to adsorb the fuel vapor, and also has a purging valve to open or close to occasionally discharge the fuel vapor adsorbed by the canister into the suction pipe through the passage according to the engine condition and thereby to burn together with the fuel-air mixture. Such a fuel vapor control apparatus employs a rubber hose to connect the canister, the suction pipe and the fuel tank, to provide a fuel vapor purging passage. Therefore, if the rubber hose is bent or eroded, it may cause a damage or breakdown, and the fuel vapor or gas may not be discharged into the suction pipe, and, on the contrary, may be diffused into the atmosphere.

In order to prevent the above trouble, there has been proposed, as disclosed in Japanese Patent Publication No. Hei 4-505491, a system having a switching valve disposed in the canister to open or close to the atmosphere, the purging control valve inserted between the canister and the suction pipe, and a pressure sensor disposed in the fuel tank, thereby to detect failure or abnormality in the fuel vapor control apparatus. When the diagnosis of the failure is initiated, the switching valve is controlled to interrupt supply of the air into the canister, the purge control valve is made to open the purging passage between the canister and the suction pipe, and the pressure sensor detects pressure change in the fuel tank.

The pressure sensor of the above system detects pressure change in the fuel tank caused by negative pressure generated in the suction pipe. However, some other system in which positive pressure is applied into the purging passage by some pressure control means and pressure change in the fuel tank from the negative to the positive is detected is also available to diagnose the failure of the fuel vapor control apparatus.

However, the conventional fuel vapor control apparatuses have the following problems.

That is, dust and other foreign particles contained in the air introduced by the switching valve may break into the switching valve and cause damages to the sealing of the switching valve, thereby to result in leakage in the valve. In other words, dust or the like adhere to the valve member and the seal of the valve is subject to wear as the valve switching operation is repeated. As a result, even when the switching valve is closed, a small amount of the fuel gas may leak out of the valve.

Further, if such leakage takes place in the switching valve, it is difficult to detect failure of the fuel vapor control apparatus even if the pressure in the fuel tank is checked while the purge control valve is opened. In other words, even when the switching valve is being closed, the pressure drop in the purging passage and the fuel tank caused by the negative pressure of the suction pipe does not come up to a value for the sensor to detect. As a result, the failure may not be checked.

The same result is expected in case of a system in which a positive pressure is introduced to the purging passage as stated above.

In order to prevent such foreign particles from breaking into the switching valve, there is proposed, as shown in FIG. 2, a system in which an air intake port of the canister is disposed at the downstream of the air cleaner filter of an engine. However, piping 32 connecting the air intake port 81 of the canister 10 and the air intake port 82 of an engine becomes long and massive, and additional check valves 83 and 84 are required to discharge air under an excessive pressure. As a result, the fuel vapor control apparatus 80 shown in FIG. 2 requires much greater space and is much more difficult to be installed into the vehicle.

SUMMARY OF THE INVENTION

In view of the above problems of the conventional apparatus, the primary object of the present invention is to provide a fuel vapor control apparatus which is reliable, compact and easy to be installed in the vehicle.

Another object of the present invention is to provide a fuel vapor control apparatus in which foreign particles may not break into an air switching valve for introducing the atmosphere into the fuel tank of an engine.

Another object of the invention is to provide a fuel vapor control apparatus in which an air filter is disposed at the upstream of the air switching valve in an air intake passage for the canister.

Another object of the invention is to provide a fuel vapor control apparatus in which an air intake unit for supplying dust-free air is disposed close to and integrally with the case of canister. As a result, complicated arrangement of the pipe is not necessary and the accommodation space is reduced to make the installation in a vehicle easier. The air intake unit comprises a housing, an air intake port held on the housing and an air filter held in the housing and disposed between the switching valve and the air intake port. The air filter removes the dust or foreign particles from the air flowing into the switching valve.

Further object of the invention is to provide a fuel vapor control apparatus in which the case of the canister and the housing of the air intake unit is detachable. The detachable arrangement enables to separate the unit from the canister and to make maintenance service or repairs on the air filter and the switching valve as well as the fuel adsorbent of the canister easier.

Further object of the invention is to provide a fuel vapor control apparatus in which the connecting portion of the case of the canister and the housing of the air intake unit has a joint partition plate having a through hole connecting the both sides thereof. This arrangement brings about reduced number of parts and cost reduction.

Further object of the present invention is to provide a fuel vapor control apparatus which comprises a pressure sensor disposed in the fuel tank to detect pressure of the purging passage or the fuel tank and means for controlling the switching valve and the purge control valve. The failure detection is made based on the output signal of the pressure sensor. A negative (or positive) pressure change is given to the purging passage, and the switching valve and the purge control valve are respectively controlled when the pressure change in the purging passage is detected so that diagnosis of failure or abnormality in the fuel vapor control apparatus can be attained.

Thus, if there is no leakage in the switching valve, in case that positive or negative pressure is applied to the fuel tank or the fuel vapor purging passage with the switching valve being closed, the pressure change at each portion is detected with high sensibility, and, consequently, stable and highly reliable failure detection for the fuel vapor control apparatus may be attained.

DETAILED DESCRIPTION OF THE PREFERRED EMBODIMENT

Figure 1A:
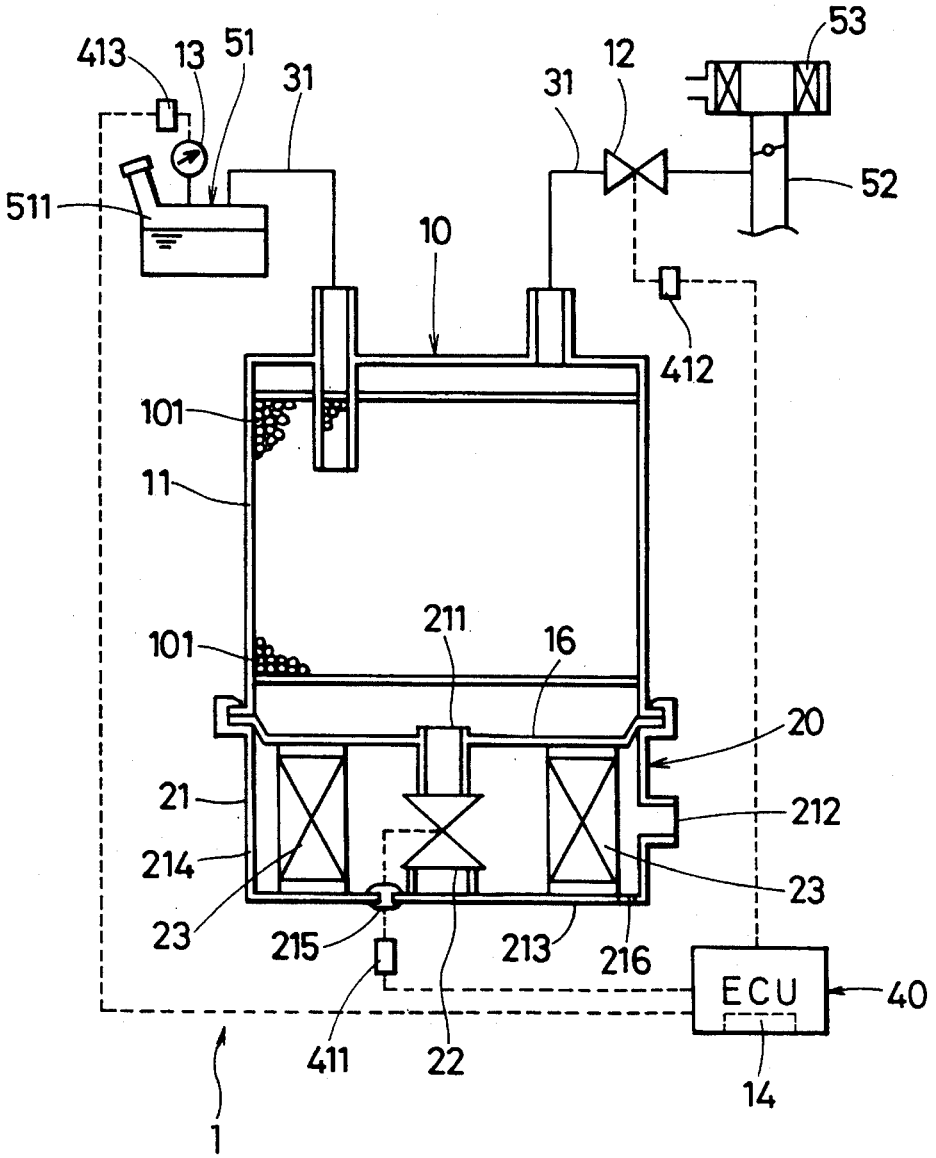
FIG. 1A is a schematic view illustrating system construction of the fuel vapor control apparatus of a present invention.

An embodiment according to the present invention will be described as follows with reference to FIG. 1A.

The fuel vapor control apparatus for an internal combustion engine comprises a fuel or gasoline vapor adsorbing canister 10 disposed in a purging passage 31 which connects the vacant space 511 of a fuel tank 51 of an engine and an engine suction pipe 52 of an engine, a purge control valve 12 disposed between the canister 10 and the suction pipe 52, and an air intake unit 20 for opening or closing a passage between the canister 10 and the atmosphere. Canister 10 has adsorbent filled therein, and the purge control valve 12 is an electromagnetic valve. Purge control valve 12 is connected to ECU 40 as shown in FIG. 1, in which broken lines show electric wiring. ECU 40 comprises a micro-computer and electronically processes data and generates control signals in the well known manner.

Air intake unit 20 has a through port 211 open to canister 10 and an air intake port 212 open to the atmosphere, and also comprises a housing 21 which forms a passage for the air to flow into the canister 10, a switching valve 22 held in housing 21 and a ring-shaped air filter 23 having elastic side plates 231 on the both sides air-tightly disposed between switching valve 22 and air intake port 212.

Figure 1B:
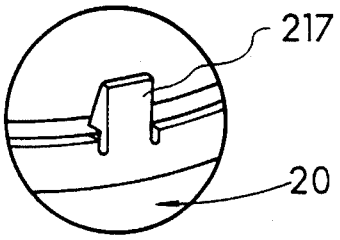
FIG. 1B is a partial side view of a detachable connecting portion of a case of a canister and a housing of an air intake unit.

A case 11 of canister 10 and housing 21 of air intake unit 20 are connected by clamps 217 formed on the periphery of housing 21, as shown in FIGS. 1A and 1B, close to each other in a unit. Case 21 and clamps 217 are made of elastic material and, therefore, case 11 and housing 21 of the air intake unit are secured so as to be detachable from each other. The connecting portion of case 11 and housing 21 is divided by a partition plate 16 jointly owned by case 11 and housing 21, and through port 211 is carried on partition plate 16.

A pressure sensor 13 is held in the upper vacant space 511 of fuel tank 51 to detect the pressure in the tank or purging passage 31. Pressure sensor 13 is connected to failure detecting unit 14 which is included in a ECU (electronic control unit) 40. ECU 40 operates switching valve 22 and purge control valve 12 to produce a pressure change in purging passage 31 and detects failure or abnormality of the fuel vapor control apparatus 1 based on the output signal of sensor 13. ECU 40 is a stored program type controller having a microprocessor. The output signal of the sensing element of pressure sensor 13 is transmitted to failure detecting unit 14 of ECU 40.

Through port 211 of partition plate 16 introduces the air into canister 10 from air intake unit 20. Air switching valve 22 is an electromagnetic valve and is connected to ECU 40, and opens or closes the air intake passage between through port 211 and air intake port 212.

Figure 1C:
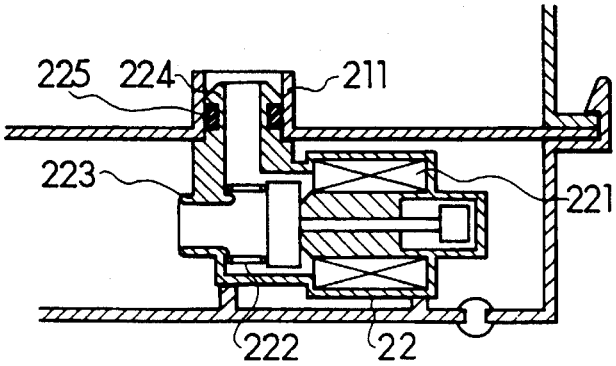
FIG. 1C is a cross-sectional partial side view of a housing of an air intake unit with an electromagnetic valve therein.
Figure 2:
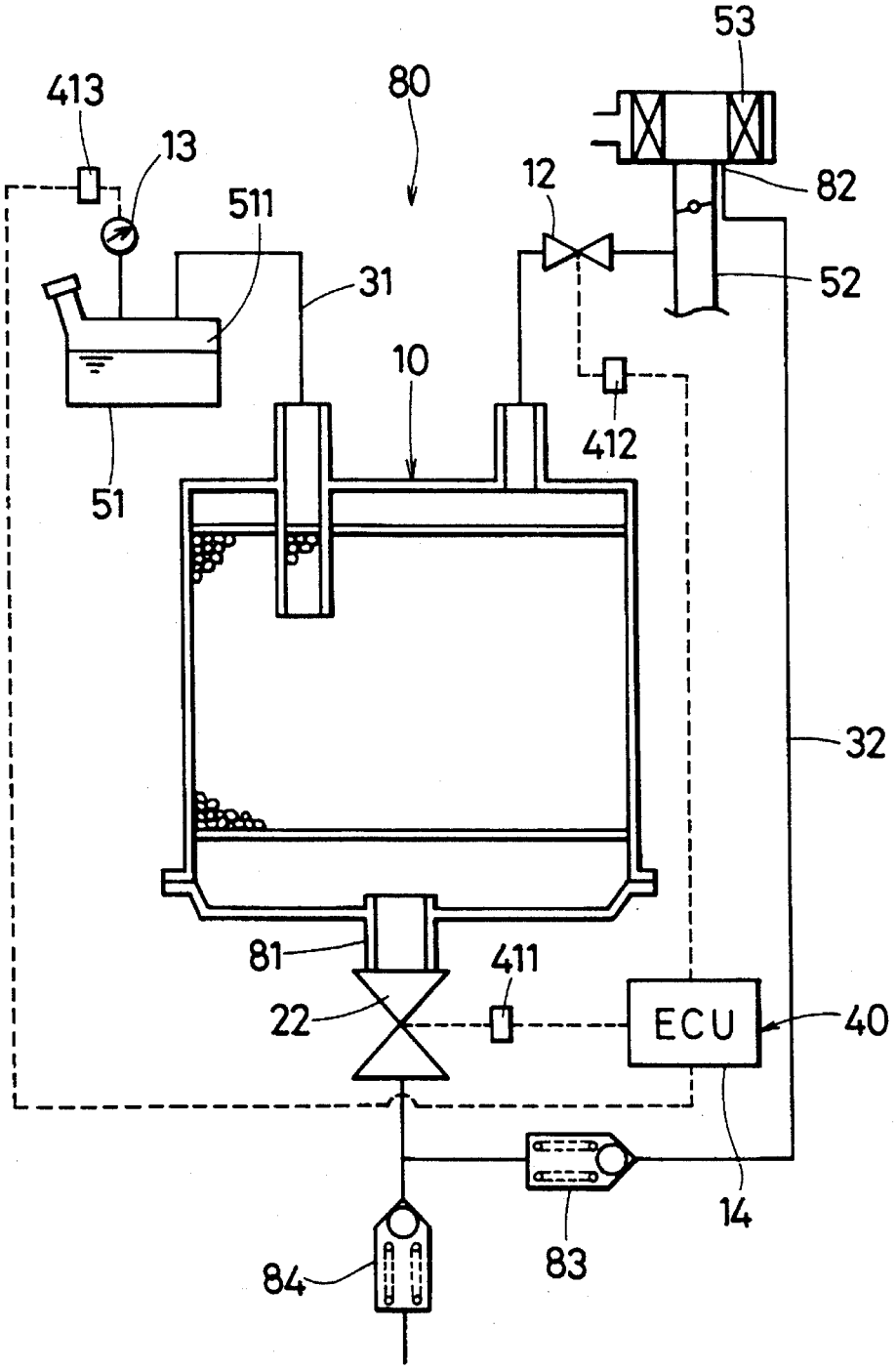
FIG. 2 PRIOR ART
FIG. 2 is a schematic view illustrating system construction of a fuel vapor control apparatus of a prior art in which air is introduced into the canister from the downstream of the air cleaner filter of an engine.

Air switching valve 22 is a known electromagnetic valve comprising a magnetic coil 221 and spring 222. An inlet port 223 of valve 22 opens to the inside of ring-shaped air filter 23 and an outlet port 224 of valve 22 with an O-ring 225 is fitted air tightly into through port 211 at the periphery as shown in FIG. 1C.

Ring-shaped air filter 23 surrounds switching valve 22 and is secured air-tightly between partition plate 16 and bottom plate 213 of housing 21. Filter 23 filtrates the air coming into the housing and removes the dust and the like from the air at the upstream of switching valve 22. Air intake port 212 is formed at the periphery 214 of housing 21.

Connectors 411 through 413 are used for electric wiring connection, and a bushing 215 is used for the wiring though a bottom plate 213. A draining hole 216 is formed in bottom plate 213 to drain out muddy water coming into the housing 21 through the air intake port 212. Suction pipe 52 is connected to an engine (not shown) and introduces the air into an engine through air cleaner filter 53.

Next, process of failure or abnormality diagnosis of the fuel vapor control apparatus 1 will be explained. Failure detecting means 14 makes the first decision to decide if any blockage is present in purging passage 31 or not, and the second decision to decide if any leakage takes place in purging passage 31 or not.

At the beginning during engine operation, purge control valve 12 is closed and, thereafter, the switching valve 22 is closed to detect an increase of pressure value $\Delta P_1$ by pressure sensor 13. This increased pressure value $\Delta P_1$ is generated by the fuel vapor produced in fuel tank 51.

Purge control valve 12 is subsequently made to open and pressure sensor 13 detects the following pressure change, in other words, decreased pressure in the fuel tank 51 caused by the negative pressure of the suction pipe 52.

If pressure decrease detected by the pressure sensor 13 is lower than a predetermined value, or the pressure change is carried in a period longer than a predetermined time period, it is decided that some blockage (by bending of the rubber hose, for example) is present. Otherwise, it is decided to be normal (the first decision).

If the first decision is made correctly, then, the purge control valve 12 is made to close, and subsequently, the pressure in the fuel tank is detected again. If the pressure change (increase) $\Delta P_2$ after a predetermined period is greater than a value given by calculation based on the pressure $\Delta P_1$, it is decided that leakage takes place in the purging passage 31. If the pressure change is smaller the given value, it is decided to be normal (the second decision).

If the leakage is present in the switching valve during the first and second decisions, the detected pressure values $\Delta P_1$, $\Delta P_2$ change as long as the leakage is present, thus, to affect decisions of failure detecting unit 14.

In other words, if the leakage in switching valve 22 increases, errors are produced in the result of the decision made by failure detecting unit 14.

However, fuel vapor control apparatus 1 has air filter 23 disposed at the upstream of switching valve 22, any foreign particle or the like may not break into switching valve 22. As a result, the seal of the valve is not subject to wear and the leakage may seldom take place in switching valve 22. Thus, the result of the decision made by failure detecting means 14 is highly reliable.

Since air intake unit 20 is connected integral with canister 10, it brings about short and compact piping, resulting in much easier installation into the vehicle.

Further, since case 11 of canister 10 and housing 21 of air intake unit 20 are connected to be detachable from each other, replacement of air filter 23 or switching valve 22 is made without difficulty.

The present invention has been described with reference to a preferred embodiment. However, it should not be limited to such one embodiment, but may be modified in many ways without departing from the spirit of the present invention.

What is claimed is:

1. A fuel vapor control apparatus for an internal combustion engine comprising:

a fuel vapor purging passage connecting a fuel tank and a suction pipe of said engine;

a canister, having a case and disposed in said purging passage, for adsorbing fuel vapor produced in said fuel tank, a fuel vapor purge control valve, disposed in said purging passage between said canister and said suction pipe;

first means, having a housing secured close to said case of said canister, an air filter and an air switching valve, for controlling introduction of dust-free air flowing into said canister, said housing having an air intake port thereon open to the atmosphere and a through port open to said canister and forming a air flow passage of the air flow coming from said intake port and flowing through said air filter and said air switching valve; and second means, having a pressure sensor disposed in said fuel tank and a computer unit which controls said fuel vapor purge control valve and said air switching valve to change the pressure of said purging passage in a predetermined manner, for detecting failure according to an output signal of said pressure sensor;

wherein said filter of said first means has a ring-shaped filter element secured air-tightly to said housing so as to surround said air switching valve to introduce thereto dust-free air.

2. A fuel vapor control apparatus for an internal combustion engine comprising:

a passage for purging fuel vapor of a fuel tank of said engine to a suction pipe of said engine;

a canister connected to said passage;

a sensor for generating a signal relating to the condition of the fuel vapor in said fuel tank;

a purge control valve disposed in said passage between said canister and said suction pipe;

means secured closely to said canister for controlling the air flowing into said passage and said fuel tank through said canister, said means having a housing disposed in an air intake passage between the atmosphere and said canister, an air filter and an electromagnetic air switching valve, the both being disposed in said air intake passage with said air filter being at the upstream of said air switching valve; and means for controlling said air switching valve and said purge control valve in a predetermined manner and determining whether failure has occurred or not according to an output signal of said sensor, wherein said means for controlling said air switching valve and said purge control valve decides that a blockage is present when a first pressure decrease value which is detected when said purge control valve is opened and said switching valve is closed is lower than a predetermined value, and decides that a leakage is present when last said means has previously decided that a blockage is not present, and the pressure increase at a predetermined period after said purge control valve has been closed is greater than a value given by calculation based on said first pressure decrease.

3. A fuel vapor control apparatus for an internal combustion engine comprising:

a fuel vapor purging passage connecting a fuel tank and a suction pipe of aid engine;

a canister, having a case and disposed in said purging passage, for adsorbing fuel vapor produced in said tank, a fuel vapor purge control valve, disposed in said purging passage between said canister and said suction pipe;

first means, having a housing secured to a bottom of said case of said canister, a ring-shaped air filter disposed air tightly to said housing and an air switching valve disposed inside said ring-shaped air filter, for controlling introduction of dust-free air flowing into said canister, said housing having an air intake port thereon open to the atmosphere and a through port open to said canister and forming an air flow passage of the air flow coming from said intake port and flowing through said air filter and said air switching valve; and second means, having a pressure sensor disposed in said fuel tank and a computer unit which controls said fuel vapor purge control valve and said air switching valve to change the pressure of said purging passage in a predetermined manner, for detecting failure according to an output of said pressure sensor.

4. A fuel vapor control apparatus for an internal combustion engine according to claim 3, wherein said second means decides that a blockage is present when a first pressure decrease value which is detected when said purge control valve is opened and said switching valve is closed is lower than a predetermined value, and decides that a leakage is present when said second means has previously decided that a blockage is not present, and the pressure increase at a predetermined period after said purge control valve has been closed is greater than a value given by calculation based on said first pressure decrease.

5. A fuel vapor control apparatus for an internal combustion engine according to claim 4, wherein said first means and said canister are detachable.

6. A fuel vapor control apparatus for an internal combustion engine according to claim 5, wherein said housing of said first means and said case of said canister are divided by a partition plate which forms jointly a part of said housing and also said case.

7. A fuel vapor control apparatus for an internal combustion engine according to claim 6, wherein said housing has a drain hole at a bottom portion.

8. A fuel vapor control apparatus for an internal combustion engine according to claim 1, wherein said first means and said canister are arranged to be detachable.

9. A fuel vapor control apparatus according to claim 1, wherein said canister and said first means are divided by a partition plate which forms jointly a part of said canister case and also said housing of said first means.

10. A fuel vapor control apparatus for an internal combustion engine according to claim 1, wherein said first means is disposed under said canister, and said housing has a drain hole at its bottom portion.

* * * * *